US009845172B2

(12) United States Patent
Jacob et al.

(10) Patent No.: US 9,845,172 B2
(45) Date of Patent: Dec. 19, 2017

(54) SCREW-TYPE CLOSURE SYSTEMS WITH MAGNETIC FEATURE

(71) Applicant: ELC Management LLC, Melville, NY (US)

(72) Inventors: Christophe Jacob, Paris (FR); Herve Bouix, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 14/865,040

(22) Filed: Sep. 25, 2015

(65) Prior Publication Data

US 2017/0088305 A1 Mar. 30, 2017

(51) Int. Cl.

| | |
|---|---|
| ***B65D 1/02*** | (2006.01) |
| ***B65D 41/04*** | (2006.01) |
| ***A45D 40/26*** | (2006.01) |

(52) U.S. Cl.

CPC ..... *B65D 1/0246* (2013.01); *A45D 40/265* (2013.01); *A45D 40/267* (2013.01); *B65D 41/0407* (2013.01); *A45D 2200/051* (2013.01)

(58) Field of Classification Search

CPC . B65D 1/0246; B65D 41/0407; A45D 40/265
USPC ..... 215/44; 132/218
See application file for complete search history.

(56) References Cited

U.S. PATENT DOCUMENTS

| | | | | |
|---|---|---|---|---|
| 6,382,450 | B1 | 5/2002 | DeRosa et al. | |
| 6,866,437 | B2 | 3/2005 | Gueret | |
| 8,132,285 | B2 * | 3/2012 | Piao | A46B 7/04 132/120 |
| 8,205,762 | B2 * | 6/2012 | Carroll | B65D 50/04 215/211 |
| 8,348,061 | B2 | 1/2013 | Komatsuda et al. | |
| 8,424,703 | B2 | 4/2013 | Meulen | |
| 8,443,993 | B1 | 5/2013 | Desselle | |
| 8,636,167 | B2 | 1/2014 | Hajichristou et al. | |
| 8,851,534 | B2 | 10/2014 | Fiedler | |
| 2007/0204872 | A1 * | 9/2007 | Kee | A45D 40/265 132/218 |

(Continued)

FOREIGN PATENT DOCUMENTS

| | | |
|---|---|---|
| CN | 202128028 U | 2/2012 |
| FR | 2973004 A1 | 9/2012 |

(Continued)

OTHER PUBLICATIONS

Written opinion of the ISA in corresponding PCT case US2016-049186.

*Primary Examiner* — King M Chu
*Assistant Examiner* — Raven Collins
(74) *Attorney, Agent, or Firm* — Peter Giancana

(57) ABSTRACT

A closure-container system comprising a screw-threaded inner cap that mounts to a screw threaded container, and an overshell that is enabled to rotate and translate relative to the inner cap. As the overshell rotates relative to the inner cap, one or more metallic magnets located in the overshell pull the cap toward one or more metallic elements associated with the container. The overshell and container make direct contact, so there is no unsightly gap. Also, the contact produces a satisfying, reassuring metallic "click" sound, accompanied by a luxurious tactile sensation that, together, dispel the silent ennui normally associated with rotating closures.

7 Claims, 7 Drawing Sheets

(56) References Cited

U.S. PATENT DOCUMENTS

| | | | |
|---|---|---|---|
| 2011/0073601 | A1 | 3/2011 | Komasuda et al. |
| 2012/0279876 | A1 | 11/2012 | Weigel |

FOREIGN PATENT DOCUMENTS

| | | | |
|---|---|---|---|
| FR | 2973005 | A1 | 9/2012 |
| WO | 2014114885 | A1 | 7/2014 |

* cited by examiner

SCREW-TYPE CLOSURE SYSTEMS WITH MAGNETIC FEATURE

FIELD OF THE INVENTION

The present invention pertains to screw-type container/closure systems, any system where the closure rotates relative to the container while being mounted and demounted from the container.

SUMMARY

Container/closure systems wherein a closure is rotated relative to a container while being mounted and demounted from the container are well known. Examples of these include containers and closures with complementary screw threads, where the closure must complete at least one full rotation relative to the container to be fully seated on the container. Another example would be a container/closure system where the closure completes less than one full rotation relative to the container to be fully seated on the container. For example, a lug style closure may rotate only ¼ of a turn or only ½ of a turn when being seated and unseat from a container. In either type of rotating system, the closure and container are drawn together through their relative rotation. Typically, the rotation stops and the closure is fully mounted on the container when some portion of the closure bottoms out on some portion of the container. Preferably, at that point the closure makes an effective fluid tight seal on the container, while at the same time, there is no discernible gap between the closure and the container. This is not always easy to achieve, and it is often the case that when a closure is fully mounted on a container there is a gap between the closure and container. This gap disturbs the aesthetic appeal of the package. Furthermore, when a closure is screwed down onto a container, and reaches the point where it is fully mounted onto the container, this event is generally silent, and presents no interest for the user. It is a problem that cries out to be rectified.

OBJECTS OF THE INVENTION

A main object of the invention is to make dull rotating closures a thing of the past by providing a luxury experience to consumers.

Another main objective is to eliminate the gap between the closure and container in screw-threaded closure systems.

SUMMARY

The present challenges are met by a closure (11) comprising a screw-threaded inner cap (6) that mounts to a screw threaded container (1), and an overshell (9) that is enabled to rotate and translate relative to the inner cap, but only when the inner cap is fully mounted (i.e. bottomed out) on the container. As the overshell rotates relative to the inner cap, one or more magnets (10) located in the overshell pull the overshell toward one or more metallic elements (2) associated with the container. The overshell and container make direct contact, so there is no unsightly gap. Also, the contact produces a satisfying, reassuring metallic "click" sound, accompanied by a luxurious tactile sensation that, together, dispel the silent ennui normally associated with rotating closures.

BRIEF DESCRIPTION OF THE FIGURES

FIG. 5A is a perspective view of the overshell. In FIG. 5B, a portion of the overshell is cut away to show the interior of the overshell.

In FIGS. 6A and 6B, the overshell is transparent in order the show how the invention works. FIG. 6A shows the overshell before it drops down onto the container. FIG. 6*b* shows the overshell after it has made contact with the container.

DETAILED DESCRIPTION

Figure 1:
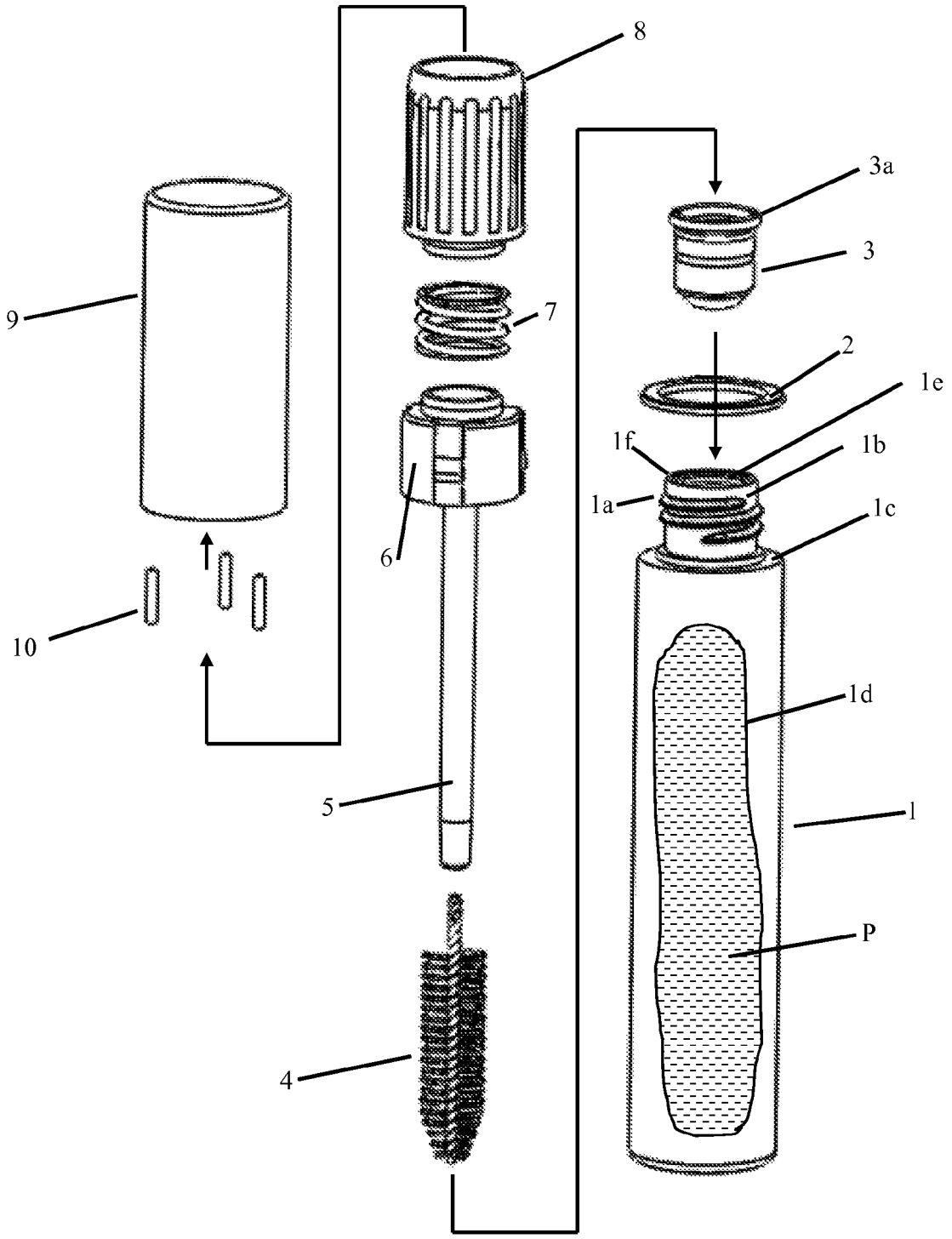
FIG. 1 is an exploded view of a screw-type closure system with magnetic feature according to the present invention.

The present invention is described in relation to a conventional mascara container and a modified closure from which depends a wand type applicator. However, the principles of the invention can be extended to virtually any system that effects a seal by a relative rotation between a container and closure. Thus, FIG. 1 depicts a container (1) that has a threaded neck (1*b*) and a shoulder (1*c*). The container is suitable for holding a cosmetic product, a personal care product or essentially any product (P) in its internal reservoir (1*d*). The product may be accessed through an opening (1*e*) in the neck of the container.

Unlike conventional containers, one or more ferromagnetic elements are associated with the container (1), in the area below the threads (1*a*) of the threaded neck (1*b*). The one or more ferromagnetic elements are positioned so that they can interact with the magnets (10) of the overshell (9). Examples of suitable ferromagnetic materials include iron, nickel, cobalt and alloys that contain ferromagnetic metals, such as steel. In some preferred embodiments, it is required that the ferromagnetic elements and the magnets (10) are metallic, and able to able to contact each other with a force that is sufficient to make an audible clicking noise. For example, molding the shoulder of the container (1) with embedded ferromagnetic particles does not meet this requirement, because the contact between the magnets (10) and the shoulder would not create the kind of satisfying, reassuring metallic "click" sound. On the other hand, for example, in FIG. 1, a metallic ring (2) (such as steel) is placed over the neck (1*b*) of the container, and rests on the shoulder (1*c*) of the container. In this embodiment, contact between the metallic magnets (10) and the steel ring (2) does create a satisfying, reassuring metallic "click" sound, with a luxury feel. The steel ring may be secured on the neck by any suitable means, such as adhesive. In those types of closure-container systems that do not have a shoulder, the one or more metallic elements (i.e. the steel ring 2) must be fixed in the area below the threads (1*a*) of the threaded neck (1*b*) by some other means.

A wiper (3) is located, in the usual manner, in the opening (1*e*) of the neck (1*b*) of the container (1), except for the flange (3*a*) of the wiper, which rests on the landing area (1*f*) of the neck. In those types of closure-container systems that have no wiper, the principles of the invention still apply. In the applicator system of FIG. 1, an applicator head (4), such as a mascara brush, is attached to a rod (5) which depends from an inner cap (6), in the usual manner well known in the art.

Figure 2:
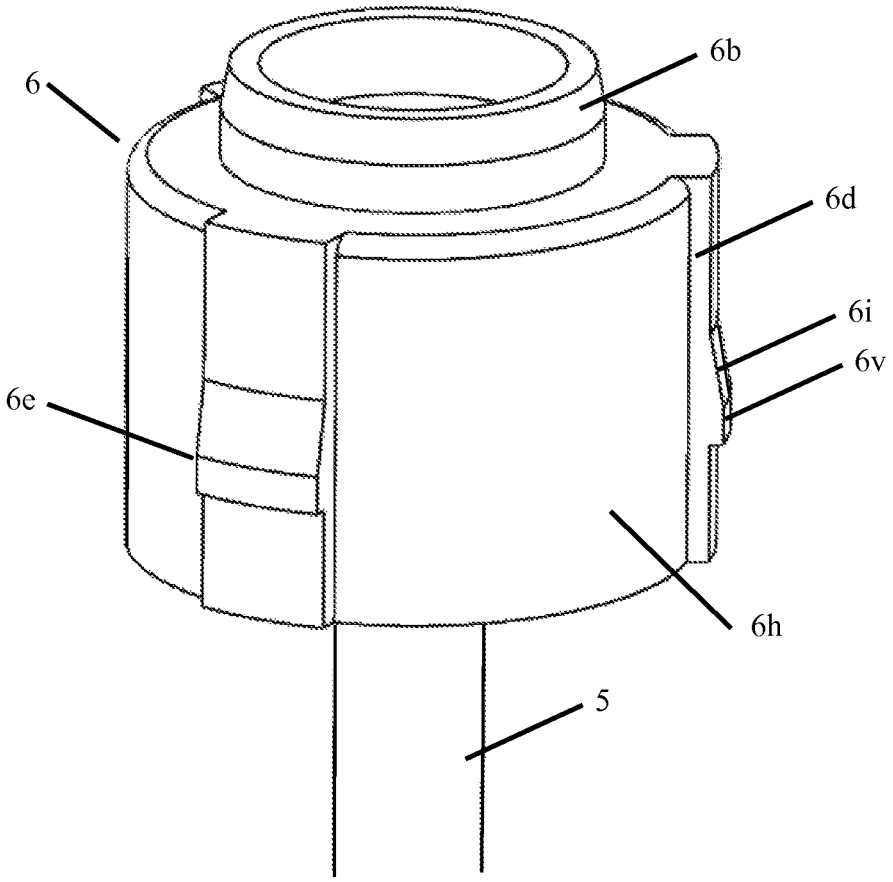
FIG. 2 is a perspective view of the inner cap.
Figure 3:
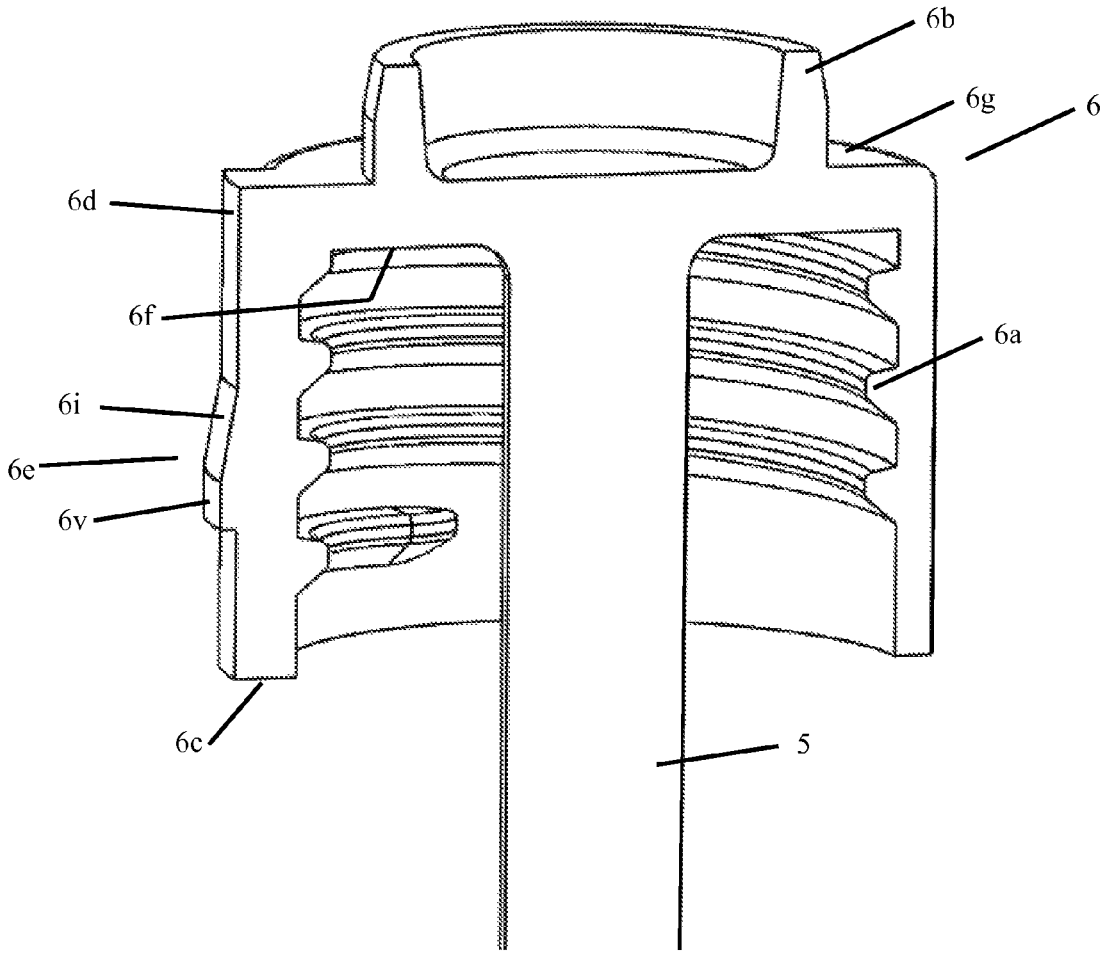
FIG. 3 is a cross sectional view of the inner cap of FIG. 2.
Figure 4:
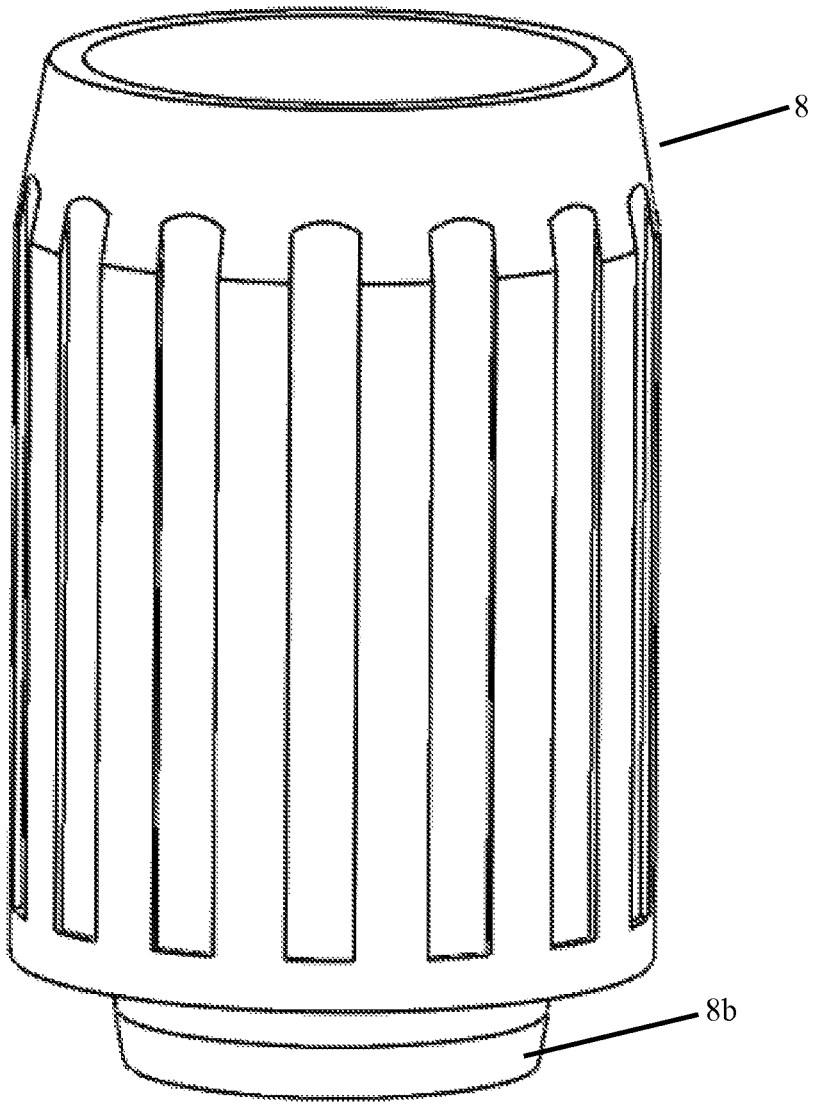
FIG. 4 is a perspective view of the inner shell.

A preferred embodiment of a closure (11) according to the present invention comprises elements 6-10, as now described. Referring to FIGS. 2 and 3, a threaded inner cap (6) comprises screw threads (6*a*) on its interior which are designed to work with the threads (1*a*) of the container (1). The threads of the container and inner cap are such that the landing area (6*f*) of the inner cap bottoms out on the landing area (1*f*) of the container before the bottom surface (6*c*) of the inner cap bottoms out on the steel ring (2) and/or shoulder (1*c*) of the container. Thus, when the inner cap is fully seated on the container, there is a gap between the bottom of the inner cap (6) and the shoulder (1*c*) of the container (see FIG. 6A). The inner cap also comprises an annular flange (6*b*) that rises from the top surface (6*g*) of the inner cap (6). On the outer surface (6*h*) of the inner cap are one or more raised portions (6*d*) that extend between the top (6*g*) and bottom (6*c*) surfaces. Rising from the surface of each raised portion is a snap fitment (6*e*) which comprises a vertical section (6*v*) and an inclined section (6*i*). Preferably, the inner cap has at least two raised portions (6*d*), more preferably at least three raised portions. Each raised portion has a height equal to the height of the inner cap (6), and a specified width. The raised portions and snap fitments are designed to cooperate with cutouts (9*d*) on the interior surface (9*a*) of the overshell (9), as will be described below.

A spring (7) sits on top of the inner cap (6). In FIG. 6, the spring is shown as surrounding the annular flange (6*b*) of the inner cap. In this way, the annular flange of the inner cap stabilizes the spring. Alternatively, the spring could be sized to fit inside the annular flange of the inner cap. The top end (7*a*) of the spring pushes against the inner shell (8). Thus, the spring tends to urge the inner cap and the inner shell apart.

The inner shell (8) is a cylindrical body that fills the upper space of the overshell (9). The inner shell is fixed within the overshell and does not move relative to the overshell. This arrangement may be achieved by a friction fit between the overshell and inner shell and/or by adhesive, for example. An annular flange (8*b*) depends from the bottom surface of the inner shell (8). In FIG. 6, the spring (7) is shown as surrounding the annular flange of the inner shell. In this way, the annular flange of the inner shell stabilizes the spring. Alternatively, the spring could be sized to fit inside the annular flange of the inner shell. The bottom end of the spring (7*b*) pushes against the inner cap (6). Thus, the spring (7) tends to urge the inner shell (8) and the overshell (9) away from the inner cap (6).

Figures 5A, 5B:
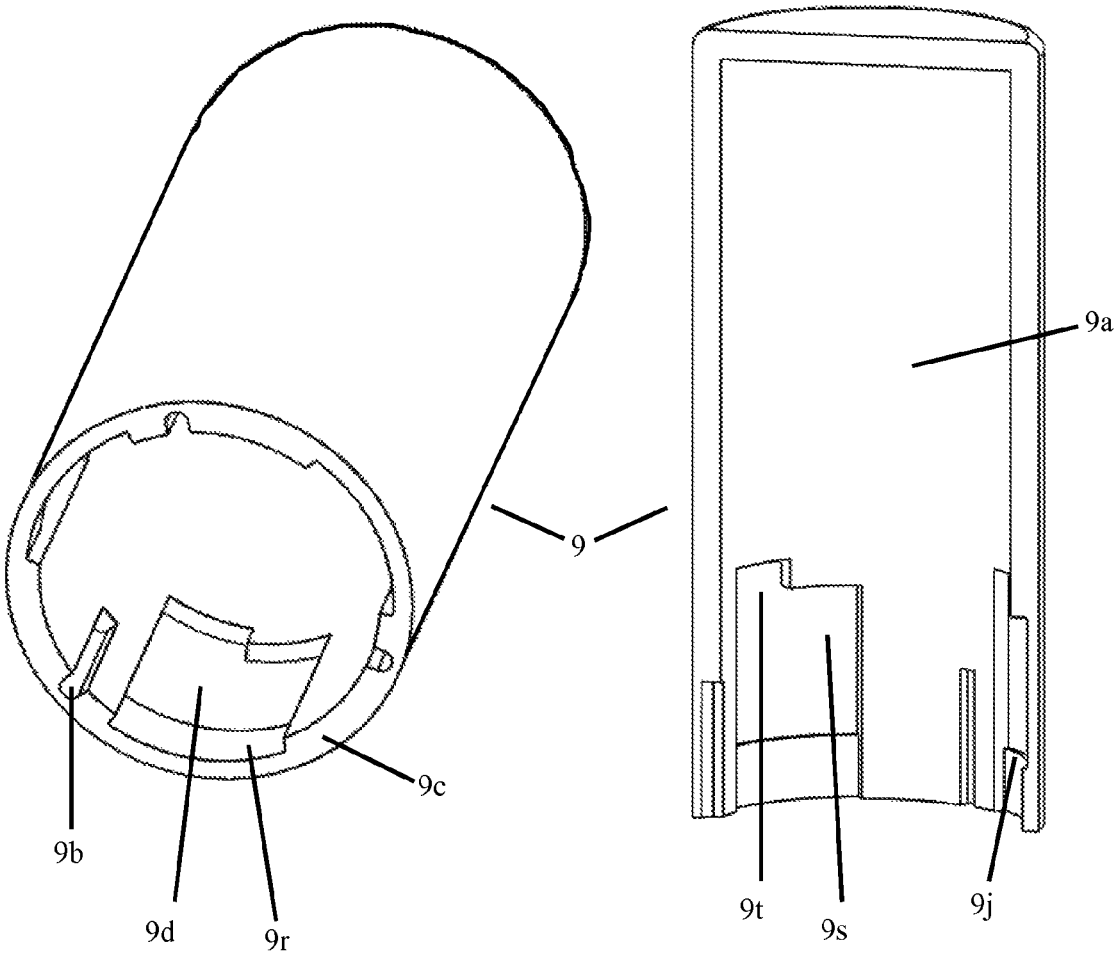
FIGS. 5A and 5B depict the same component.

Referring to FIG. 5, the overshell (9) is the part of the closure that a user gasps to open and close the container (1). The overshell has an interior surface (9*a*), and a bottom or opened end (9*c*), through which the overshell houses the inner cap (6), the spring (7), the inner shell (8) and the metallic magnets (10). The inner shell and magnets are firmly connected to the interior surface of the overshell, so that they cannot move relative to the overshell. However, the overshell is able to translate and rotate with respect to the inner cap. For example, the overshell (9) is able to slide up or down so that the inner cap is closer to or further away from the opened end (9*c*) of the overshell. One or more channels (9*b*) are cut into the interior surface of the overshell. The channels open up onto the opened end (9*c*) of the overshell. Each channel is designed to receive a metallic magnet (10). Preferably, there are at least two such channels, more preferably at least three. The metallic magnets may be retained in the channels by a friction fit or adhesive. The bottom of each magnet may extend slightly below the opened end (9*c*) of the overshell, so that they can contact the one or more ferromagnetic elements (i.e. metal ring 2) in the area below the threads (1*a*) of the container (1). As the separation between the magnets and metal ring is decreases (i.e. while the closure is being screwed down on the container), and before the landing area (6*f*) of the inner cap bottoms out on the landing area (1*f*) of the container, the combined force of attraction of all of the magnets for the metal ring must be able to overcome the extension force of the spring (7). The metallic magnets themselves may be simple bar magnets of cylindrical or rectangular cross section. For maximum effect, each magnet should be oriented so that one pole of the magnet is close to the metal ring, and the other pole is far from the metal ring. One preferred magnet is cylindrical neodymium-iron-boron (NdFeB) magnet, having a 1 mm diameter, 7 mm height, and a magnetization grade of N45. Magnets having a lesser magnetization grade, such as at least N20, at least N25 or at least N30 may also be useful.

Also located on the interior surface (9*a*) of the overshell (9) are one or more cutouts (9*d*). The cutouts are designed to cooperate with the one or more raised portions (6*d*) located on the outer surface (6*h*) of the inner cap (6). There is one cutout (9*d*) for each raised portion (6*d*). Each cutout comprises a taller section (9*t*), shorter section (9*s*), and a reduced section (9*r*) that opens onto the opened end (9*c*) of the overshell. At the top end of the reduced section there is a ledge (9*j*) that sometimes abuts the snap fitment (6*e*) of the inner cap. The height of the shorter section (9*s*) is at least as tall, and approximately equal to, the height of the raised portion (6*d*) of the inner cap (6). In order for the overshell to be slipped onto the inner cap, the cutouts (9*d*) must be aligned with and slide over the raised portions (6*d*). As the overshell slides over the inner cap, the reduced section (9*r*) of the overshell allows the snap fitment (6*e*) to enter into the cutout (9*d*). The inner cap flexes inward until the vertical section (6*v*) of the snap fitment passes over the ledge (9*j*). At this point, each raised portion of the inner cap is confined within a cutout of the overshell, the inner cap is retained in the overshell (9), and, ordinarily, cannot back out of the overshell. Although the raised portions of the inner cap are confined within the cutouts of the overshell, some relative movement between the inner cap and the overshell is still possible, as we now describe.

Function of the Screw-Type Closure Systems with Magnetic Feature

Figures 6A, 6B:
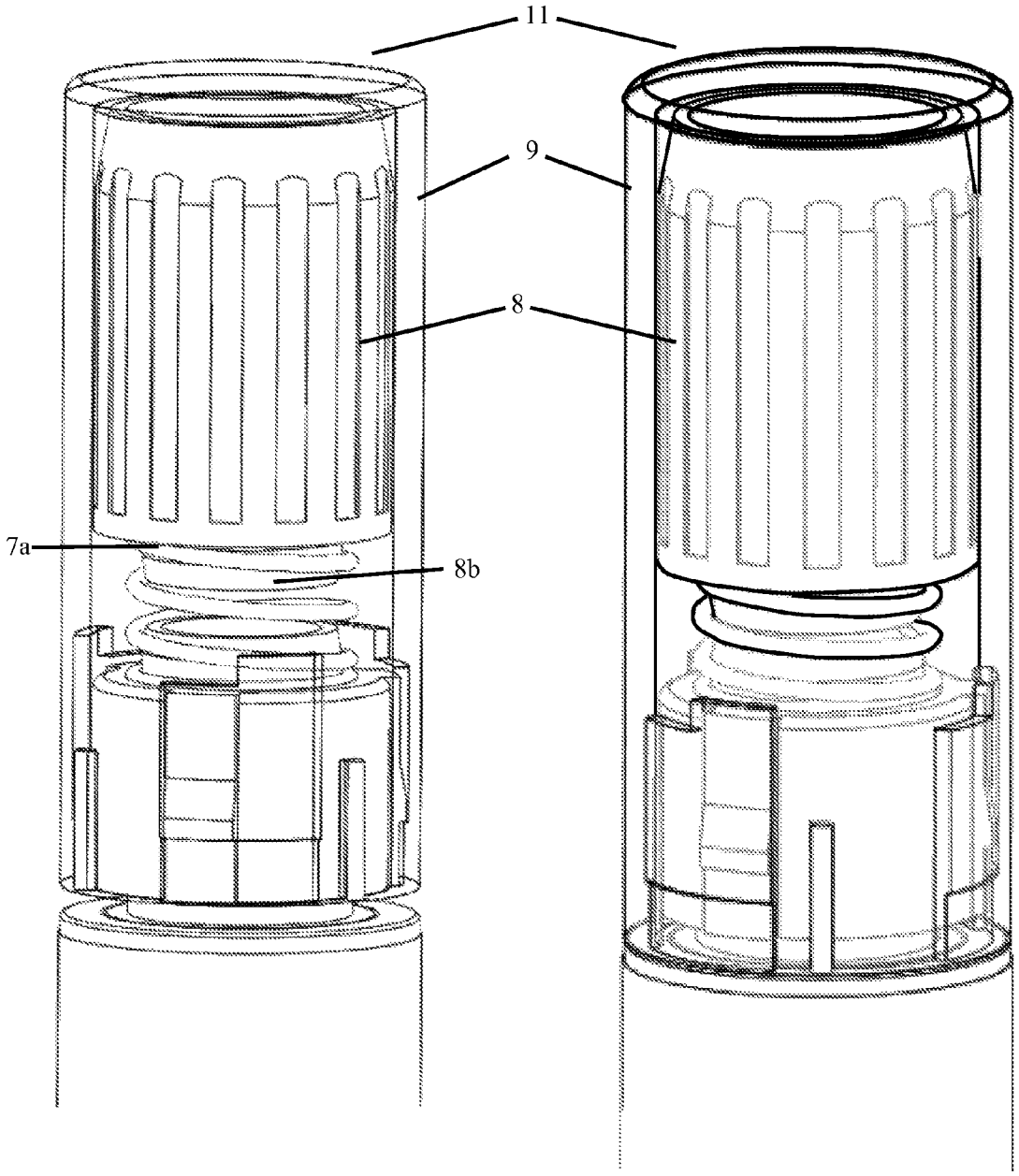
FIGS. 6A and 6B depict the same component.

Referring to FIG. 6A, the raised portion (6*d*) of the inner cap (6) is situated in the shorter section (9*s*) of the overshell (9). At this point, the spring (7) tends to bias the inner shell (8) and the overshell upward relative to the inner cap, so that the inner cap is urged closer to the opened end (9*c*) of the overshell, and so that the ledge (9*j*) of each cutout (9*d*) pushes against a snap fitment (6*e*). Before the closure is fully seated on the container (1), if the overshell is rotated clockwise to close the container, then the inner cap (6) may also rotate clockwise due to the net force of the ledges (9*j*) on the snap fitments (6*e*). As the magnets (10) get closer to the metal ring (2), the magnetic force would be sufficient to overcome the spring bias, and the overshell would be pulled downward relative to the inner cap, if not for the top of the raised portion (6*d*) abutting the top of the shorter section (9*s*) of the cutout (9*d*). However, once the landing area (6*f*) of the inner cap bottoms out on the flange (3*a*) of the wiper (3), the overshell is able to rotate with respect to the inner cap (6) (as much as 10° to 45°, for example), with the result that the taller sections (9*t*) of the cutouts (9*d*) of the overshell move over the raised portions (6*d*) of the inner cap. Once this happens, the attraction of the magnets (10) for the metal ring (2) overcomes the spring bias, and pulls the overshell downward (relative to the inner cap and container 1) toward the ferromagnetic elements (i.e. metal ring 2), until the magnets contact the metal ring. Ideally, at this point, the opened end (9*c*) of the overshell is resting on the metallic ring, so there is no discernible gap. This is depicted in FIG. 6B. The force of contact between the magnets and the metal ring is sufficient to make an audible clicking noise, and create a satisfying, reassuring metallic "click" sound, with a luxury feel. The downward travel of the overshell is effected by magnetism, not by the user, and this provides the user with magical or luxurious sensation. Because the overshell (9) is able to slide downward independently of the inner cap, the present closure system ensures that there will be no gap between the container and closure when the package is in its closed configuration.

At this point, the raised portions (6*d*) of the inner cap (6) are trapped in the taller sections (9*t*) of the cutouts (9*d*) of the overshell (9). If we rotate the overshell counter-clockwise, to unscrew the closure from the container (1), the overshell and inner cap move as one due to the shorter side walls (9*w*) of the taller sections (9*t*) abutting the raised portions (6*d*) of the inner cap. As the inner cap rides on the threads (1*a*) of the container, the inner cap and overshell begin to rise, separating the magnets (10) and the metal ring (2). Therefore, to effect this counter-clockwise rotation, a user has to supply the force needed to overcome the magnetic force of attraction between the magnets (10) and the metal ring (2). When the magnetic force is weak enough due to this separation, the spring (7) pushes the overshell (9) up relative to the inner cap (6). At this point, the overshell can move independently of the inner cap. As the counter-clockwise rotation of the overshell (9) continues, the inner cap is now at rest, and the shorter cutouts (9*s*) of the overshell move over the raised portions (6*d*) of the inner cap. Soon enough, the side walls of the shorter sections (9*s*) push against the raised portions (9*d*) of the inner cap, so that the inner cap resumes counter-clockwise rotation with the overshell, until the inner cap is unscrewed from the container.

The design of the present invention is such that the overshell (9) experiences a net force from the magnets (10) and the spring (7). The net force of the magnets and spring is made to change direction (up or down relative to the inner cap 6) by screwing or unscrewing the inner cap on the container (1). When screwing the inner cap onto the container, the magnets get close enough to the ferromagnetic elements (2) so that the force of attraction overcomes the spring bias. At that point, the net force is downward, and the overshell can translate downward if the taller sections (9*t*) are positioned over the raised portions (6*d*). Likewise, when unscrewing the inner cap from the container, the magnets move away from ferromagnetic elements (2) until the spring bias can overcome the magnetic force of attraction, at which point the net force on the overshell is upward, and the overshell can translate upward if the taller sections (9*t*) are over the raised portions (6*d*). Thus, the overshell is enabled to translate up and down relative to the inner cap only when the raised portions (6*d*) of the inner cap (6) are located in the taller sections (9*t*) of the overshell (9), and not when the raised portions (6*d*) are located in the shorter sections (9*s*) of the overshell (9).

Figure 7:
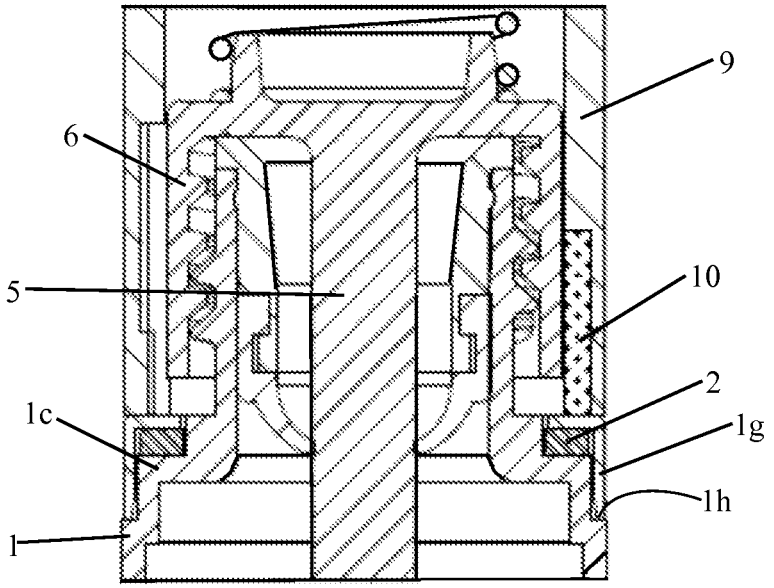
FIG. 7 shows a detail view, in cross section, of the neck area, in a preferred embodiment.

In one preferred embodiment of the invention (see FIG. 7), the container (1) is provided with a metal collar (1*g*) that fits around the neck (1*b*) and rests on top of the metal ring (2). In this way, the metal ring 2 is hidden and the container has a trimmed, finished appearance. Optionally, the container may have a lower shoulder (1*h*). In this case, the collar rests on the lower shoulder, and perhaps the metal ring, and may fit tightly to the shoulder (1*c*) to hold itself in place.

What we claim is:

1. A container-closure system comprising:

a container (1) that comprises:

an internal reservoir (1*d*) that is suitable for holding a product, a threaded neck (1*b*), a shoulder (1*c*), an opening (1*e*) in the neck of the container, and one or more ferromagnetic elements (2) located in the area below the threads (1*a*) of the threaded neck (1*b*);

a closure (11) that comprises:

an overshell (9) that comprises:

an interior surface (9*a*), one or more cutouts (9*d*) located on the interior surface, wherein each cut comprises a taller section (9*t*), a shorter section (9*s*), and a ledge (9*j*); and an inner shell (8) firmly connected to the interior surface (9*a*) of the overshell (9), such that it cannot move relative to the overshell;

an inner cap (6) that comprises:

screw threads (6*a*) for mounting to the container (1), an outer surface (6*h*) that has one or more raised portions (6*d*) and snap fitments (6*e*), each raised portion and snap fitment being confined within one of the cutouts (9*d*) of the overshell (9); and a rod (5) that depends from the inner cap into the internal reservoir (1*d*) of the container (1), the rod having an applicator head (4) attached thereto;

a spring (7) located between the inner cap (6) and the inner shell (8), that tends to bias the ledges (9*j*) against the snap fitments (6*e*);

one or more magnets (10) firmly connected to the interior surface (9*a*) of the overshell (9), that tend to bias the overshell toward the ferromagnetic elements (2);

wherein:

the overshell (9) is able to translate up and down relative to the inner cap (6) only when the raised portions (6*d*) of the inner cap are located in the taller sections (9*t*) of the cutouts (9*d*), and not when the raised portions are located in the shorter sections (9*s*).

2. The container-closure system of claim 1 wherein the one or more ferromagnetic elements (2) is a metal ring placed over the neck (1*b*) of the container (1), and resting on the shoulder (1*c*) of the container.

3. The container-closure system of claim 1 wherein each magnet is retained in a channel (9*b*) that is cut into the interior surface (9*a*) of the overshell (9), and that opens up onto the opened end (9*c*) of the overshell.

4. The container-closure system of claim 3 wherein the bottom of each magnet extends slightly below the opened end (9*c*) of the overshell (9).

5. The container-closure system of claim 1 wherein the magnet is a neodymium-iron-boron (NdFeB) magnet, having a magnetization grade of N45.

6. The container-closure system of claim 4 wherein when the inner cap (6) is fully seated on the container (1), there is a gap between the bottom (6*c*) of the inner cap and the shoulder (1*c*) of the container.

7. The container-closure system of claim 1 further comprising a lower shoulder (1*h*) and a metal collar (1*g*) that fits around the neck (1*b*) of the container (1), and rests on the lower shoulder to hide the metal ring (2).

* * * * *